US005609305A

United States Patent [19]

Webb

[11] Patent Number: 5,609,305

[45] Date of Patent: Mar. 11, 1997

[54] APPARATUS FOR PROVIDING AN AIR CURTAIN

[75] Inventor: Richard Webb, Fairfield, Ohio

[73] Assignee: Vortec Corporation, Cincinnati, Ohio

[21] Appl. No.: 308,662

[22] Filed: Sep. 19, 1994

[51] Int. Cl.[6] ..... B05B 1/04

[52] U.S. Cl. ..... 239/590.3; 239/590.5; 239/597

[58] Field of Search ..... 239/597, 590.3, 239/553.3, 553.5, 590, 590.5

[56] References Cited

U.S. PATENT DOCUMENTS

| | | | |
|---|---|---|---|
| 2,921,748 | 1/1960 | Kane | 239/597 X |
| 3,699,872 | 10/1972 | Kruger | 239/597 X |
| 3,741,643 | 6/1973 | Smith et al. | 239/597 X |
| 3,750,955 | 8/1973 | Nakai et al. | 239/597 X |
| 4,046,492 | 9/1977 | Iglis | 417/197 |
| 4,667,882 | 5/1987 | Pacific | 239/597 X |
| 4,930,705 | 6/1990 | Broerman | 239/590.5 |

FOREIGN PATENT DOCUMENTS

| | | | |
|---|---|---|---|
| 372902 | 6/1990 | European Pat. Off. | 239/597 |
| 384111 | 1/1907 | France | 239/597 |
| 7200490 | 8/1972 | Japan | 239/597 |

*Primary Examiner*—Kevin Weldon

*Attorney, Agent, or Firm*—Tilton, Fallon, Lungmus & Chestnut

[57] ABSTRACT

An air flow apparatus for providing a continuous curtain of air or other fluid includes a body member defining a first elongate plenum chamber, at least one inlet opening through which the first plenum chamber receives compressed air and an outlet opening for discharging air from the body member. The apparatus may also include a second plenum chamber (which communicates with the outlet opening) and at least one passageway connecting the first and second plenum chambers. The body member discharges the air without deflecting it towards one of its outer surfaces.

11 Claims, 2 Drawing Sheets

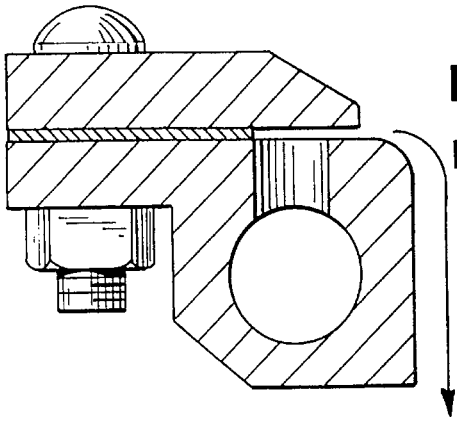
Fig. 1
Prior Art
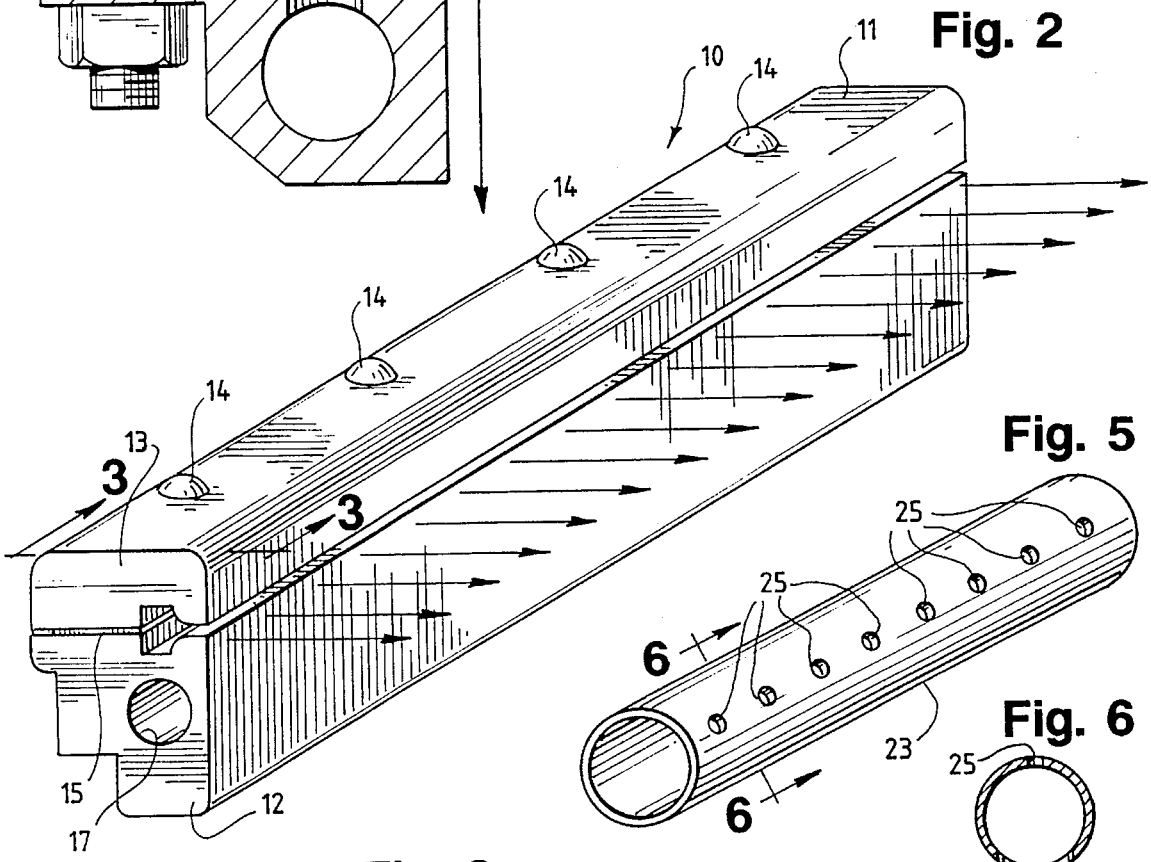
Fig. 2
Fig. 5
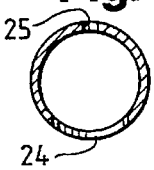
Fig. 6
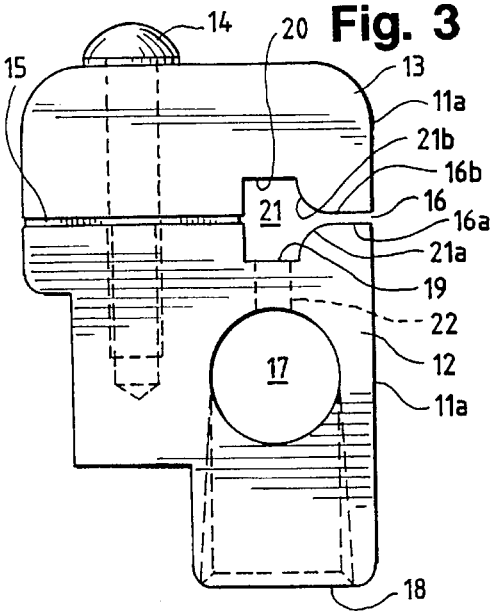
Fig. 3
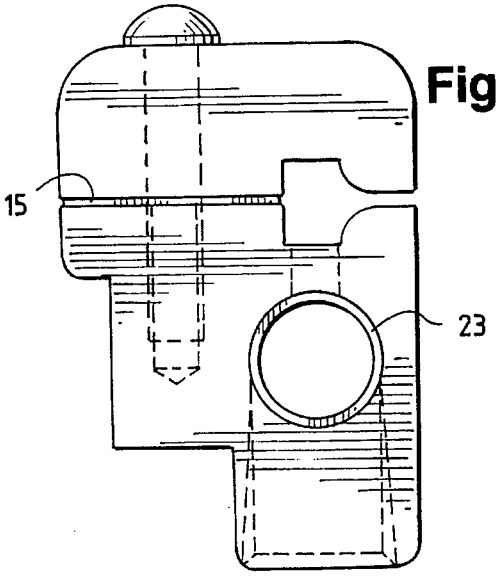
Fig. 4

Fig. 7
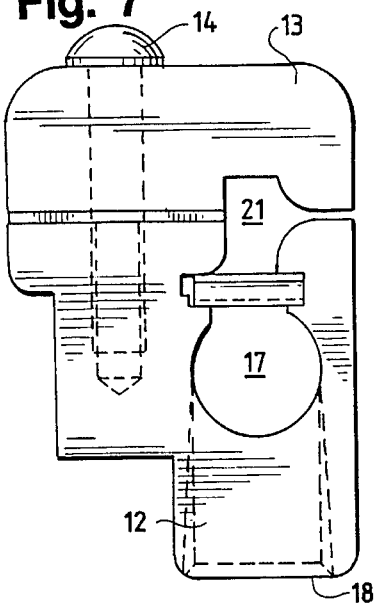
Fig. 8
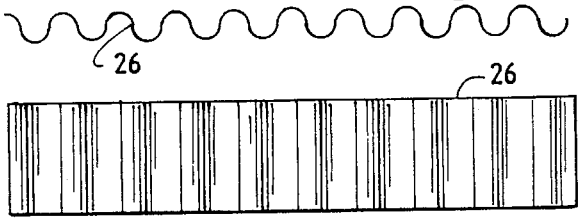
Fig. 9
Fig. 14
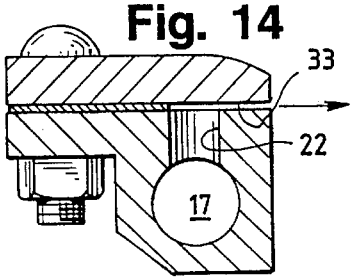
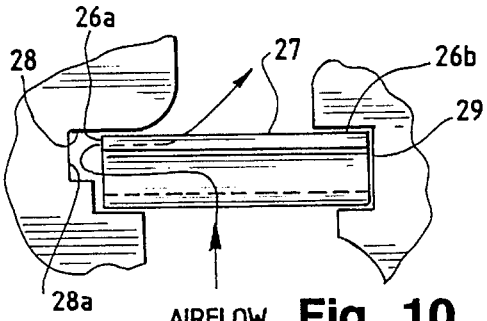
Fig. 10
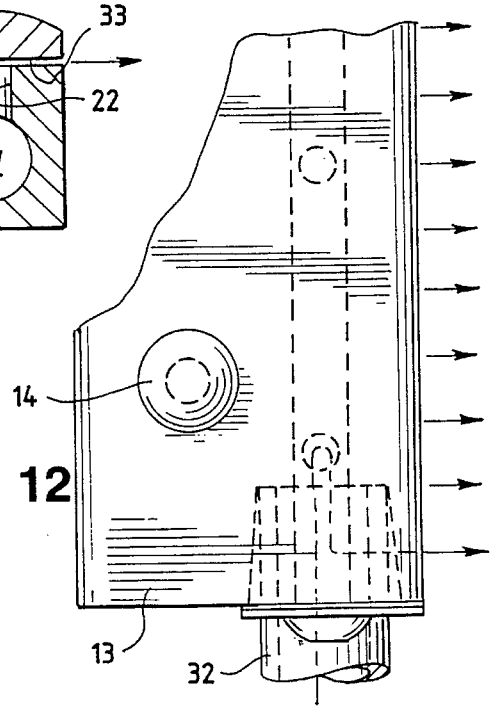
Fig. 12
Fig. 13
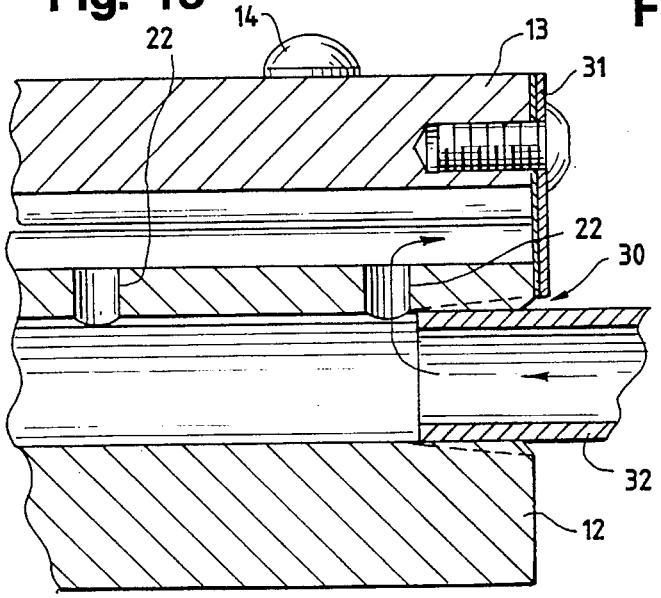
Fig. 11
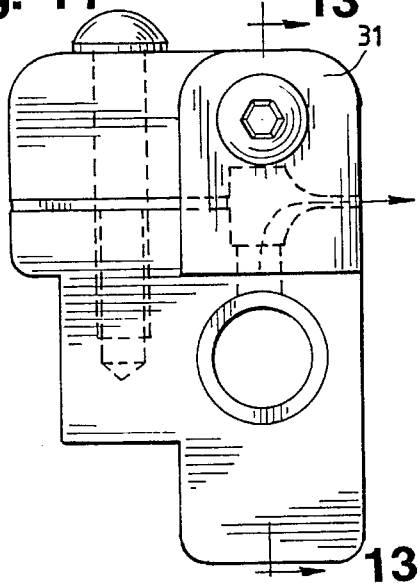

APPARATUS FOR PROVIDING AN AIR CURTAIN

BACKGROUND OF THE INVENTION

1. Field of the Invention

The present invention relates generally to an air flow apparatus and, more specifically to an air flow apparatus which provides a thin and continuous layer of jetting fluid.

2. Description of the Prior Art

The prior art includes a variety of air flow devices that produce air curtains and columns. For examples, Iglis U.S. Pat. No. 4,046,492 which issued Sep. 6, 1977, discloses an air flow amplifier with an annular nozzle for producing a column of air. Broerman U.S. Pat. No. 4,930,705, which issued Jun. 5, 1990, discloses an air flow apparatus with a linear nozzle that provides a thin layer or curtain of jetting air.

The devices identified above typically include a protuberance at the outlet for redirecting the discharging air onto an angled surface of the device. This direction change of the air results in a reduction in its velocity and a loss of kinetic energy.

Other prior devices do not employ means for deflecting the air as it discharges. One such device, known as a coanda-type air flow amplifier, discharges air out of a slit and directs it along a curved surface and eventually along a plane disposed generally perpendicularly to the slit (see FIG. 1). The air in this application also loses velocity after discharging from the device and accordingly loses kinetic energy.

The apparatus of the present invention amplifies the velocity of fluid through its body and discharges the fluid through a linear nozzle or slit without redirecting the flow after discharge. It isolates the turbulence of the fluid it receives and distributes and regulates air flow evenly to the linear outlet. This design allows introduction of fluid into the device at a variety of positions without requiring an increased length. It facilitates the combination of two or more of the devices in end to end relation.

The apparatus of the present invention produces greater thrust efficiencies and air velocities than those of prior devices. It provides a construction which minimizes the expense of manufacture and assembly and gives precise, uniform and reliable performance. It comprises a small number of components which provide a continuous curtain of fluid.

SUMMARY OF THE INVENTION

In accordance with one embodiment of this invention, an air flow apparatus which provides a curtain of jetting fluid (e.g., air) includes an elongate body member made of metal or any other material of high strength and rigidity. This member defines a first, elongate plenum chamber for receiving the fluid and at least one inlet opening through which the first plenum chamber receives the fluid from a source.

The body member may also define a second, elongate plenum chamber which receives fluid from the first plenum chamber through at least one passageway. The first plenum chamber suppresses any turbulence in the fluid which the apparatus receives; and it distributes and regulates the flow of the fluid to the second plenum chamber. The second plenum chamber further suppresses turbulence in the fluid before the fluid discharges from the device.

In addition, the body member defines an elongate outlet opening or nozzle through which the fluid discharges after flowing through the second plenum chamber. This outlet opening restricts the flow of fluid, increasing its velocity as it discharges. After it discharges from the body member, the fluid continues to travel in the direction it flowed immediately before discharging, i.e., the body member does not redirect the flow of the fluid after it discharges from the slit or linear nozzle.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a sectional view of a prior art Coanda-type curtain transvector;

FIG. 2 is a perspective view of one embodiment of the air flow apparatus embodying the present invention;

FIG. 3 is a sectional view taken along line 3—3 in FIG. 2;

FIG. 4 is the sectional view of FIG. 3 showing a modification, including a flow rate adjustment tube disposed in the first plenum;

FIG. 5 is a perspective view of the flow rate adjustment tube shown in FIG. 4;

FIG. 6 is a sectional view taken along line 6—6 in FIG. 5;

FIG. 7 is the sectional view of FIG. 3, showing a modification of the connection between a first and second plenum chamber in the apparatus of the present invention;

FIG. 8 is a side view of a baffle used to separate the first and second plenum chambers;

FIG. 9 is a plan view of the baffle shown in FIGS. 7 and 8;

FIG. 10 is an enlarged view of the baffle and baffle seat arrangement shown in FIG. 7;

FIG. 11 is the sectional view of FIG. 3 with a modification, including an inlet at the side of the apparatus and a modified end plate;

FIG. 12 is a plan view of the modification shown in FIG. 11;

FIG. 13 is a sectional view taken along line 13—13 in FIG. 11; and

FIG. 14 is a sectional view of another modification of the air flow apparatus of the present invention.

While the applicant will describe the invention in connection with one embodiment, and a number of modifications, one should understand that the invention is not limited to this embodiment. Furthermore, one should understand that the drawings are not necessarily to scale. In certain instances, the applicant may have omitted details which are not necessary for an understanding of the present invention.

DETAILED DESCRIPTION OF THE DRAWINGS AND AN EMBODIMENT

Turning now to the drawings, FIGS. 2 and 3 show an embodiment of an air flow apparatus generally at 10. The apparatus includes a main body member 11 with a base member 12 and a cap member 13. The members 12 and 13 are elongate and made of metal or any other suitable material of high strength and rigidity. Bolts 14 (or any other suitable securing devices) secure the cap member 13 to the base member 12; and a shim 15, disposed between the members 12 and 13, determines the size of the thickness of a linear slit 16 (see discussion below) defined by the members 12 and 13. The shim 15 is a strip of metal foil or any other suitable material.

The base member 12 has an elongate opening 17 formed through it. This opening 17 has a circular configuration; and it extends the length of the base member 12. The opening 17 is the first plenum of the apparatus 10. A pair of metal plate and gasket assemblies (not shown) secured at opposite ends of the main body member 11 with bolts close the ends of the plenum chamber 17 as well as the ends of a second plenum chamber described below.

The base member 12 has an inlet 18 through which the plenum chamber 17 receives compressed fluid, e.g., air. This inlet opening 18 is threaded to receive a fitting or any other suitable connector which provides fluid communication with a source of compressed fluid (not shown). Alternatively, the base member 12 may include two or more inlet openings for the first plenum chamber 17.

The inlet opening 18 extends perpendicularly to the longitudinal axis of the first plenum chamber 17. Thus, when compressed air flows into the first plenum chamber 17, its direction of flow changes. This change in direction of flow of the fluid creates turbulence at the inlet opening. In addition, the sudden expansion of the fluid when it enters into the first plenum chamber 17 also creates turbulence. The first plenum chamber 17 isolates this turbulence before the fluid moves further into the apparatus 10.

The base member 12 also has a trough 19 formed along the end adjacent the cap member 13. The trough 19 and a trough 20 formed in cap member 13 combine to define a second plenum chamber 21 disposed between the base member 12 and the cap member 13. The second plenum chamber 21 communicates with the first plenum chamber 17 through passageways 22.

The passageways 22 include a plurality of round bores, with one spaced a predetermined distance apart from the other. In the embodiment shown, the passageways 22 lie in equal distance from each other. They distribute the fluid evenly in the second plenum chamber 21. Alternatively, the passageways may lie at unequal spacings.

One side of the second plenum chamber 21 has curved surfaces 21*a* and 21*b* which merge into flat surfaces 16*a* and 16*b*. The curved surfaces 20*a* and 20*b* help reduce turbulence in the second plenum 20 by gradually reducing the cross-section through which the fluid must travel before it enters the gap 15. The flat surfaces 16*a* and 16*b* define the linear nozzle or slit 16 and determine the direction in which the fluid will discharge from the apparatus 10. In the embodiment shown the direction of discharge is perpendicular to the face 11*a* of the main body member 11.

The elongate slit or passage 16 has a substantially uniform width throughout its length. It defines a nozzle which restricts the flow of fluid. Thus, the fluid discharges from this nozzle at a velocity substantially greater than the velocity at which it enters the apparatus 10.

The main body member 11 does not include any structure which deflects the discharging fluid. In the embodiment shown, the slit walls 16*a* and 16*b* lie perpendicularly to the face 11*a* of the main body member 11. Thus, the fluid discharges in a direction which lies perpendicularly to this face. Alternatively the surfaces 16*a* and 16*b* may lie parallel to each other but at an angle to the face 11*a*. In this case, the fluid would discharge at an angle to the face 11*a*.

In operation, compressed fluid enters the main body member 11 through the inlet 18 and into the first plenum 17. There, the turbulence in the incoming fluid dissipates as the fluid fills the first plenum chamber 17. The fluid then flows into passageways 22 and into the second plenum chamber 21. The fluid then discharges from the apparatus 10 through the nozzle 16 and outwardly of the apparatus.

Thus, the applicant has provided an air flow apparatus capable of providing a continuous layer of jetting fluid. While the applicant has shown one embodiment of the invention, one will understand, of course, that the invention is not limited to this embodiment since those skilled in the art to which the invention pertains may make modifications and other embodiments of the principles of the invention, particularly upon considering the foregoing teachings.

For example, as shown in FIGS. 4–6, a modification includes placing a flow rate adjustment tube 23 into the first plenum chamber (see FIG. 4). This tube is made of metal or any other suitable material. It includes an opening 24 which cooperates with the inlet 18 of the main body member 11 and outlet openings 25 which cooperate with the passageways 22. The tube has a predetermined outside diameter which allows the tube to fit snugly inside the first plenum chamber 17 while still allowing the tube to rotate.

In addition, the tube 23 has a length slightly greater than the length of the main body member 11 so that the end plates on the compression gaskets at opposite ends of the apparatus 10 may hold the tube in place and prevent unintended rotation inside the first plenum chamber 17 after placement in a desired position. By rotating and adjusting the tube 23 in relation to the base member 12, the open area between the holes 25 in the tube 23 and the passageways 22 in the base member 12 changes, resulting in a change in the flow rate of fluid.

One may adjust the flow between the first and second plenums by removing an end plate and gasket from the main body member 11 and adjusting the tube 23. Alternatively, a shaft (not shown) connected to one end of the tube 23 for rotating the tube may extend through a suitable opening in an end plate of the apparatus 10 and allow adjustment of the tube 23 without removal of the end plate.

Another modification of the apparatus 10 (shown in FIGS. 7–10) includes a baffle 26 which is an elongate piece of corrugated metal or any other material of high strength and rigidity. This baffle 26 extends along the entire length of a passageway 27 between the first and second plenum chambers. Edge portions 26*a* and 26*b* extend into grooves 28 and 29 in the base member 12. The groove 28 has a portion 28*a* which cooperates with the corrugations in the baffle 26 to channel the fluid from the first plenum chamber 17 to the second plenum chamber 21.

One may insert the baffle 26 in place through either one side of the main body member 11 or the other and secure the baffle 26 in place by securing the end plates and compression gaskets to the main body member 11. The baffle 26 has a length slightly greater than the length of the main body member so that the end plates and compression gaskets at opposite ends of the member 11 may securely hold the baffle in place. Alternatively, the baffle may have a length equal to or less than the length of the main body member.

Yet another modification (See FIGS. 11–13) includes an optional inlet position 30 at the side of the apparatus 10. In this modification, the end plate 31 merely covers a portion of the end surface of the apparatus 10. As shown in FIG. 13 a supply tube 32 extends into the first plenum 17 from a side of the main body member 12.

Finally, the apparatus 10 may include only one plenum chamber 17, as shown in FIG. 14. In this modification, the passageway means 22 connects the chamber 17 with a slit 33, through which the apparatus discharges fluid.

The applicant, therefore, by the appended claims, intends to cover any modifications and other embodiments that incorporate those features which constitute the essential features of this invention.

What is claimed is:

1. An apparatus for providing a thin, continuous film of jetting gas fluid, said apparatus comprising: an elongate body member defining a first elongate plenum chamber for receiving compressed fluid, inlet opening means for providing fluid communication between the first plenum chamber and the outside of the body member, said first plenum chamber receiving compressed fluid through said inlet opening means, a second elongate plenum chamber for receiving compressed fluid from the first plenum chamber, passageway means disposed between the first and second plenums for conveying compressed fluid from the first plenum chamber to the second plenum chamber, and outlet opening means for providing fluid communication between the second plenum chamber and the outside of the body member, said second plenum chamber discharging the fluid through said outlet opening means, said outlet opening means restricting the flow of the fluid as it discharges; said body member including a base segment, a cap segment, and securing means for securing the two segments together; edge portions of the two segments defining opposite surfaces of the outlet opening and an outer face of the body member adjacent the outlet opening from which the gas fluid discharges outwardly of the body; outer portions of the opposite surfaces of the outlet opening being flat and generally parallel to one another and the outer face adjacent the outlet opening being generally flat without any overhanging portions proximate the opening; said securing means maintaining the surfaces of the outlet opening at a predetermined position.

2. The apparatus of claim 1, wherein the passageway means includes at least one bore that extends from the first to the second plenum chambers.

3. The apparatus of claim 1, wherein a baffle with corrugations secured at a predetermined position in the elongate body member defines the passageway means.

4. The apparatus of claim 1, further comprising a tube member rotatably mounted in the first plenum, said tube member defining at least one opening for cooperating with the passageway means to adjust the flow-rate of fluid moving from the first to the second plenum.

5. The apparatus of claim 1, wherein the inlet opening means includes at least one bore which extends from a side of the base segment to the first plenum.

6. The apparatus of claim 1, wherein the first and second plenum lie generally parallel to one another.

7. The apparatus of claim 1, wherein the first plenum has a generally circular cross-section.

8. The apparatus of claim 1, wherein the second plenum has a generally rectangular configuration.

9. The apparatus of claim 8, wherein the elongate slit extends generally perpendicularly to the outer face of the elongate body member.

10. The apparatus of claim 3, wherein the baffle extends across substantially the entire length of the first plenum.

11. The apparatus of claim 1, wherein inner portions of the opposite surfaces of the outlet opening are curved.

* * * * *